US011846142B2

(12) United States Patent
Zhan et al.

(10) Patent No.: US 11,846,142 B2
(45) Date of Patent: Dec. 19, 2023

(54) INTERCONNECT FOR DOWNHOLE INSTRUMENTS

(71) Applicant: CHINA PETROLEUM & CHEMICAL CORPORATION, Beijing (CN)

(72) Inventors: Sheng Zhan, Houston, TX (US); Sam Seldon, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 0 days.

(21) Appl. No.: 17/663,629

(22) Filed: May 16, 2022

(65) Prior Publication Data

US 2023/0366274 A1 Nov. 16, 2023

(51) Int. Cl.
*E21B 17/02* (2006.01)
*E21B 47/017* (2012.01)

(52) U.S. Cl.
CPC ..... *E21B 17/028* (2013.01); *E21B 47/017* (2020.05)

(58) Field of Classification Search
CPC ..... E21B 17/028; E21B 47/017
See application file for complete search history.

(56) References Cited

U.S. PATENT DOCUMENTS 5,219,298 A * 6/1993 Morin ..... E21B 17/028 439/736
6,123,561 A * 9/2000 Turner ..... E21B 17/028 439/194
10,865,639 B1 * 12/2020 Bishop ..... E21B 47/01
2004/0004202 A1 * 1/2004 Eguchi ..... F16K 1/303 251/149.5
2010/0300677 A1 12/2010 Patterson, III et al.
2014/0151055 A1 * 6/2014 Wright ..... E21B 33/038 166/344
2015/0340803 A1 11/2015 Li et al.
2021/0005352 A1 * 1/2021 Okoniewski ..... E21B 43/2401
2022/0034170 A1 * 2/2022 Lafleur ..... H01R 13/533

FOREIGN PATENT DOCUMENTS

CN 112983292 A 6/2021
WO 2020205138 A1 10/2020
WO WO-2020205138 A1 * 10/2020 ..... E21B 17/042

* cited by examiner

*Primary Examiner* — Amine Benlagsir
(74) *Attorney, Agent, or Firm* — NKL Law; Allen Xue

(57) ABSTRACT

An interconnector for connecting downhole instruments includes a male connector assembly and a female connector assembly. The male connector assembly has a first housing and a male rotatable connector that are connected together. The female connector assembly has a second housing and a female rotatable connector. The second housing is adapted to receive the female rotatable connector. The male rotatable connector has a first end having a plurality of cylinders that are sequentially and concentrically connected, and a second end adapted to receive a first plurality of electrical wires, and a first plurality of electrical contacts disposed on the plurality of cylinders. The female rotatable connector has a first end having a cavity having a plurality of steps adapted to receive the plurality of cylinders in the male rotatable connector, and a second end adapted to receive a second plurality of electrical wires.

9 Claims, 6 Drawing Sheets

INTERCONNECT FOR DOWNHOLE INSTRUMENTS

TECHNICAL FIELD

The present disclosure provides a connector for connecting downhole instruments, especially adapted for oil and gas exploration.

BACKGROUND

Modern oil and gas exploration techniques rely heavily on the ability to measure the operating conditions and the formation environment while drilling. For example, directional drilling requires real-time monitoring of the inclination and azimuth of the wellbore at the location near the drill bit, which can be accomplished by using accelerometers and magnetometers. Further, data collected by the sensors are transmitted to the surface using a mud-pulse telemetry system that includes a mud pulser or an electromagnetic telemetry system that has a broader bandwidth. Instruments that measure and transmit such directional information are often referred to as measurement-while-drilling (MWD) instruments/tools. Directional drilling also requires formation properties to guide the drill bit to reach the pay zone. The formation properties include density, porosity, resistivity, acoustic-caliper, magnetic resonance and formation pressure, each are measured by a special instrument. Instruments that measure formation properties are often referred to as logging-while-drilling (LWD). In this disclosure, MWD and LWD instruments may be used interchangeably and may also be collectively referred to as downhole instruments. The numerous downhole instruments required for drilling need to be mechanically connected and/or electrically connected using an interconnector. There is a need for an interconnector that is mechanically strong, corrosion resistant, and easy to install.

SUMMARY

In one embodiment of the current disclosure, an interconnector for connecting downhole instruments has a male connector assembly and a female connector assembly. The male connector assembly has a first housing and a male rotatable connector that may be connected together. The female connector assembly has a second housing and a female rotatable connector. The second housing is adapted to receive the female rotatable connector. Further, the male rotatable connector has a first end composed of a plurality of cylinders that are sequentially and concentrically connected, and a second end adapted to receive a first plurality of electrical wires, a first plurality of electrical conduits disposed on the plurality of cylinders, and the female rotatable connector has a first end having a cavity having a plurality of steps adapted to receive the plurality of cylinders in the male rotatable connector, and a second end adapted to receive a second plurality of electrical wires.

In some embodiments, the interconnector also has one or more centralizers affixed to an outer surface of the second housing. In some instances, each of the one or more centralizers have one or more holes, each hole receives a screw, a metal disk covering a top of the screw, and a filler sealing the hole.

In other embodiments, the male connector assembly and the female rotatable assembly are configured to be integrated together by a tubular fastener.

In still other embodiments, the male connector assembly has a first machine key affixed to the second end of the male rotatable connector, a second machine key affixed to a first end of the first housing, and a split coupling configured to receive the first machine key and the second machine key so as to form a connection between the male rotatable connector and the first housing. The first machine key can be made from metal or from an epoxy resin.

This disclosure also provides a downhole instrument module that includes a downhole instrument connected to the interconnector. The downhole instrument can be a directional sensor, a pulser, a Gamma probe both non-focused and focused, a battery, an alternator, a gyroscope, a vibration monitor, a pressure sensor, an electromagnetic (EM) telemetry, resistivity sensor, a nuclear logging tool, or a sonic/acoustic sensor.

Two or more such downhole instruments modules can be connected together via the male connector assembly and the female connector assembly to form a tool string.

BRIEF DESCRIPTION OF THE DRAWINGS

The teachings of the present invention can be readily understood by considering the following detailed description in conjunction with the accompanying drawings.

Figure 1:
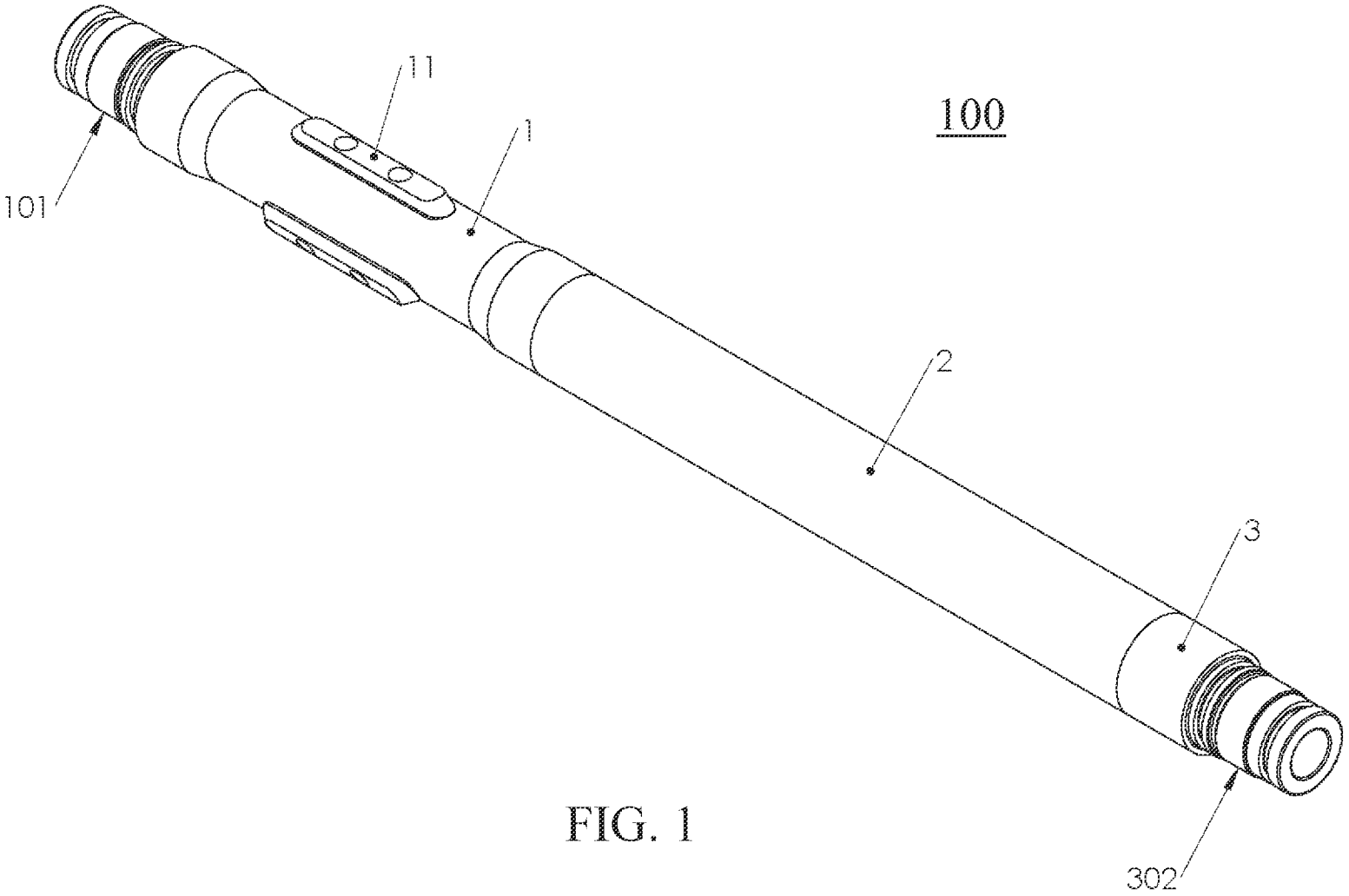
FIG. 1 is an isometric view of the interconnector, having the male rotatable connector assembly and the female connector assembly.

The following table lists the reference numerals in the drawings.

| | |
|---|---|
| 100 - interconnector | 1 - female connector housing |
| 101 - uphole/proximal end | 102 - downhole/distal end |
| 2 - pressure housing | 3 - male connector housing |
| 301 - uphole/proximal end | 302 - downhole/distal end |
| 303 - machine key | 4 - female rotatable connector |
| 401 - solder cups | 5 - male rotatable connector |
| 501 - ground conductor band | 502- conductor bands for Hall effect sensor power |
| 503 - conductor bands for motor phase power | 504 - conductor bands for Hall effect sensor signals |
| 505 - solder cups | 506 - machine key |
| 6 - female rotatable connector cap | 7 - male rotatable connector cap |
| 8 - split coupling | 11 - rubber centralizer |
| 12 - metal disk | 13 - rubber centralizer pad |
| 14 - filler | 200 - directional sensor |

DETAILED DESCRIPTION

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the disclosure.

Figure 2:
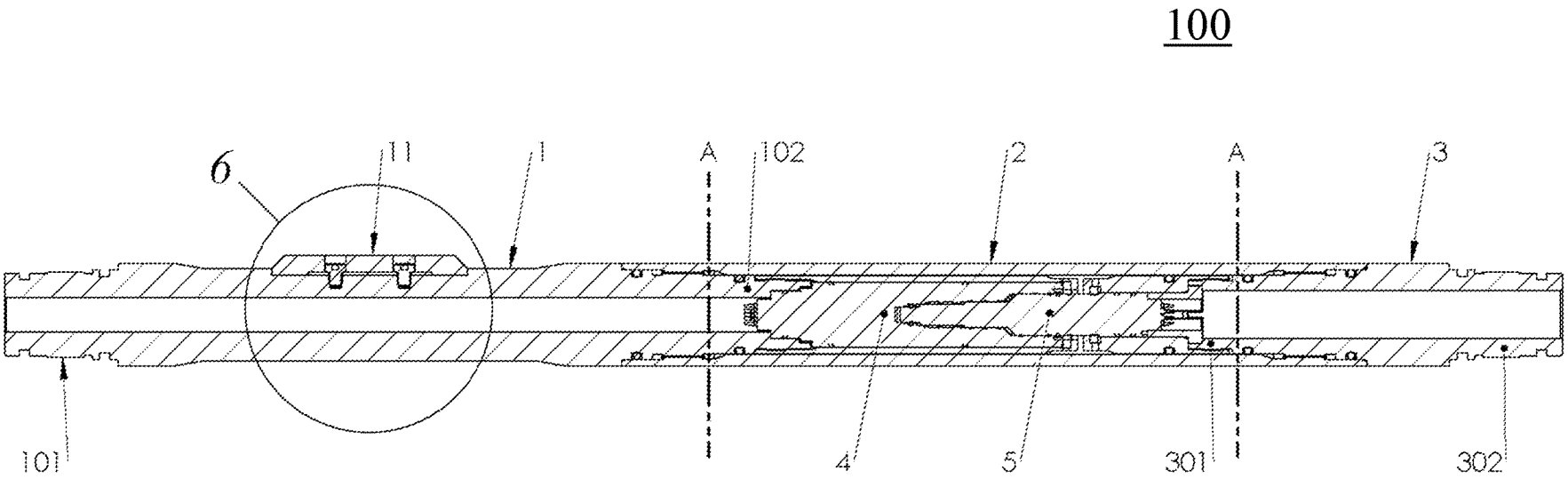
FIG. 2 is a sectional view of the interconnector of FIG. 1.

FIGS. 1 and 2 show an interconnector 100 having a male connector assembly and a female connector assembly integrated together through a pressuring housing 2. The female connector assembly has a housing 1 having an uphole end 101 (i.e., proximal end) and a downhole end 102 (i.e., distal end). The female rotatable connector 4 is inserted into the downhole end 102 of the housing 1. The male connector assembly has a housing 3 having an uphole end 301 and a downhole end 302, and the male rotatable connector 5. The male rotatable connector 5 has one end received by the female rotatable connector 4 and the other end disposed about the downhole end 302 of the housing 3.

Figure 3:
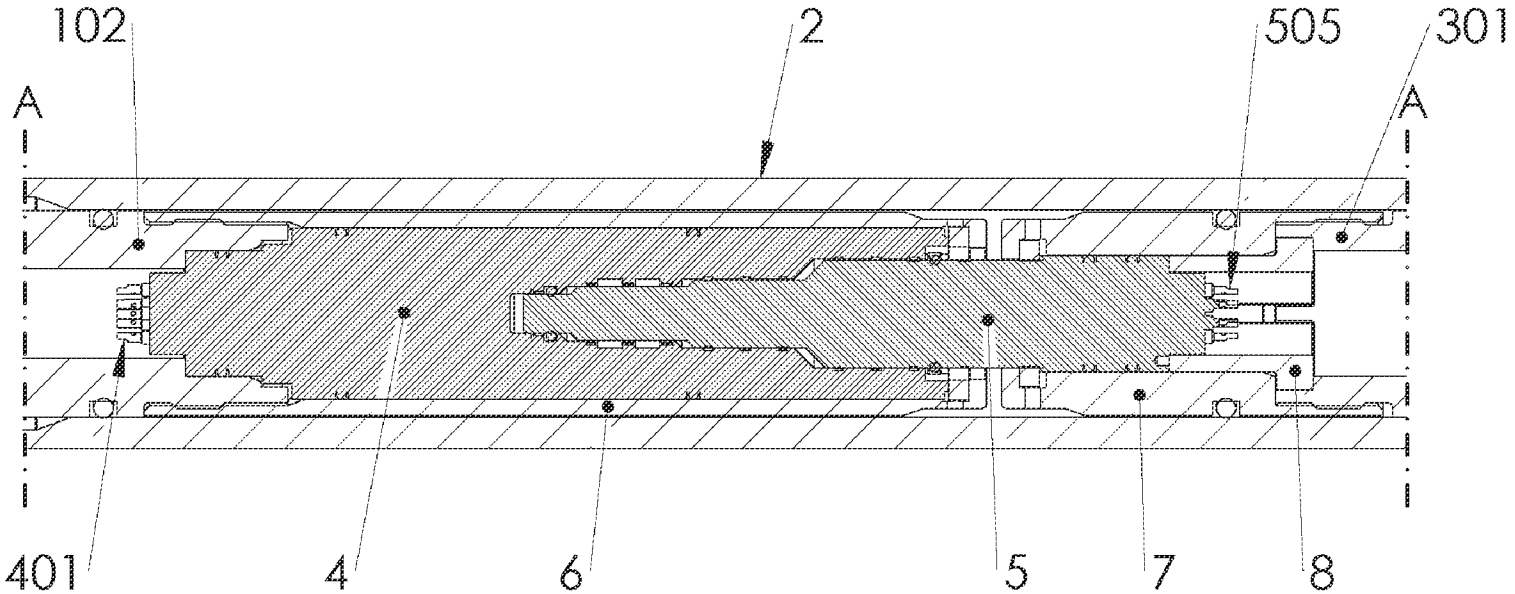
FIG. 3 shows details of section A-A in FIG. 2.
Figure 4:
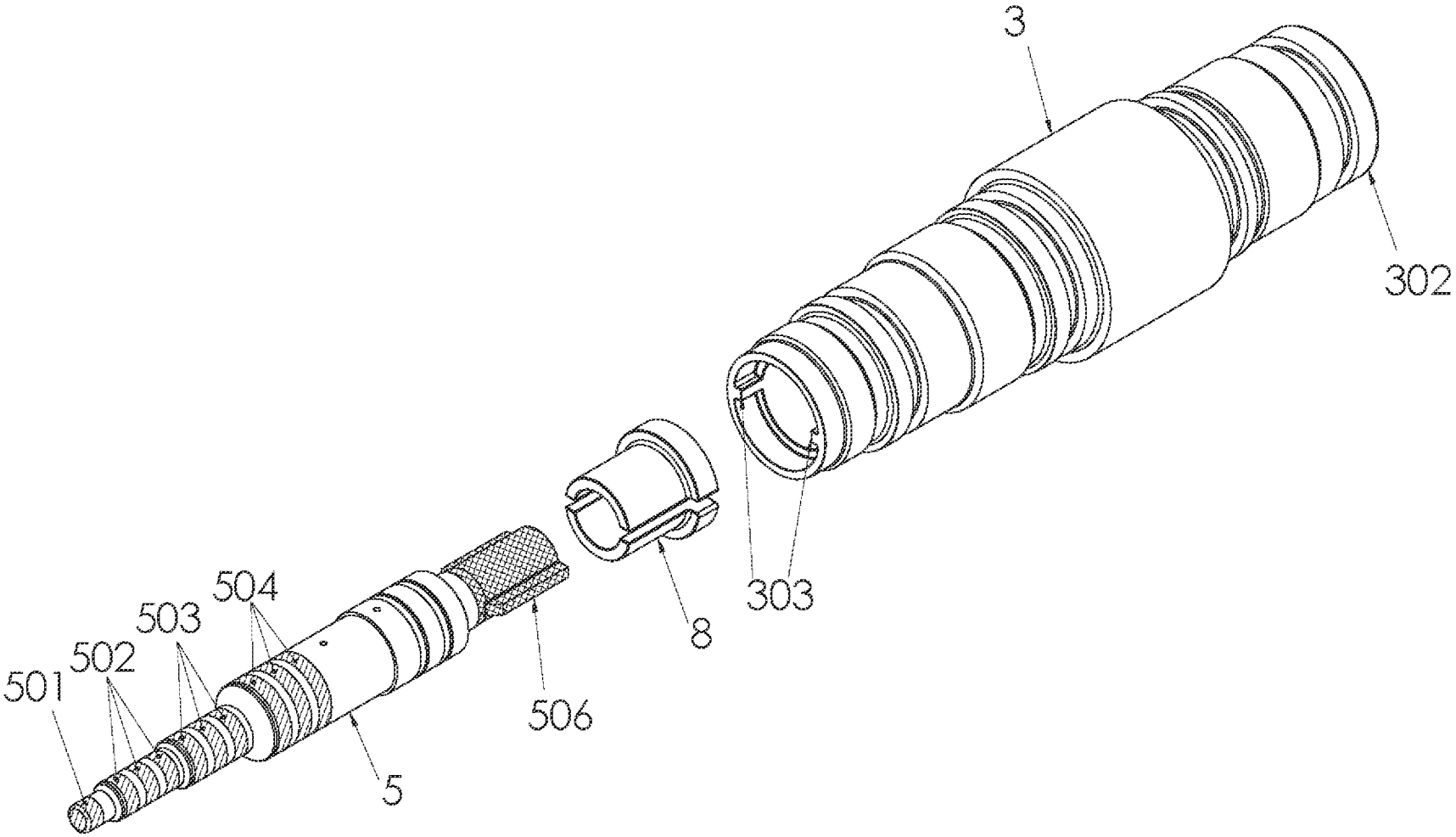
FIG. 4 shows an assembly view of the male connector assembly.

FIG. 3 shows the A-A section in FIG. 2 while FIG. 4 is an isometric view of the male connector assembly. Together they provide more details regarding the connections between the male and female connector assemblies. First, both the female rotatable connector 4 and the male rotatable connector 5 have solder cups 401 and 505, respectively, for electric wiring. Further, both the female rotatable connector 4 and the male rotatable connector 5 have electrical contact points that cooperatively form conduits for power and signals when assembled. Used herein, electrical contacts can be any suitable means that form a conduit for an electrical current when in contact with one another.

As shown in FIGS. 3 and 4, one embodiment of the male rotatable connector 5 has four cylinders of various diameters sequentially and concentrically disposed. The outer surfaces of the four concentric cylinders form four steps. Each step has one or more electrical contacts disposed thereon. In some embodiments, conductor band 501 disposed on the first step is for electrical grounding; conductor bands 502 disposed on the second step are for Hall effect sensor power for powering a Hall sensor switch of a DC brushless motor (not shown) electrically and signally connected to the interconnector; conductor bands 503 disposed on the third step are for supplying power to the DC brushless motor (not shown); and conductor bands 504 disposed on the fourth step are for passing signals to the Hall effect sensor (not shown). In other embodiments, all conductor bands have the same voltage and current rating so that each of them can carry power or data signals. In still other embodiments, the conductor bands may have different ratings so that some of them are designed to carry power while others are configured to carry data signals.

Correspondingly, the distal portion of the female rotatable connector 4 forms a cavity having 4 steps corresponding to the 4 steps in the male rotatable connector 5. Each of the 4 steps in the female rotatable connector 4 also have contacts configured to form electrical connections with the conductor bands on the male rotatable connector 5 after assembly, such as Ramtac© available from RAMPART PRODUCTS.

The male rotatable connector 5 also have a machine key 506, while the housing 3 also has a machine key 303. When assembled, the machine keys 506 and 303 are locked in place by the split coupling 8 so that the male rotatable connector 5 and the housing 3 are integrated and adapted to rotate together. The machine key 506 can be made from metal or from an epoxy resin. For example, the epoxy machine key 506 is bonded to the solder cup end of the male rotatable connector using a mold. Liquid epoxy is poured into the mold and allowed to fully cure. The mold is then removed to obtain the machine key 506 affixed to the end of the male rotatable connector 5 as shown in FIG. 5.

Further, as shown in FIG. 3, the female rotatable connector 4 is retained by the cap 6 that is threadedly connected to the uphole end 101 of the housing 1. Likewise, the male rotatable connector is retained by the cap 7, which is threadedly connected the downhole end 302 of the housing 3. Accordingly, the female connector assembly and the male connector assembly are self-contained parts that can be tied together by tightening the pressure housing 2 to form an integrated interconnector.

During installation, the uphole end 101 of the female connector assembly is connected to a first downhole instrument while wires/cables from the first downhole instrument are soldered to the solder cups 401. Likewise, the downhole end 302 is mechanically connected to a second downhole instrument while wires/cables from the second downhole instruments are soldered to the solder cups 505. The pressure housing is threaded onto either the female connector assembly or the male connector assembly. Subsequently, the male rotatable connector 5 can slide into the female rotatable connector 4 and firmly connected by tightened the pressure housing 2.

Figure 5:
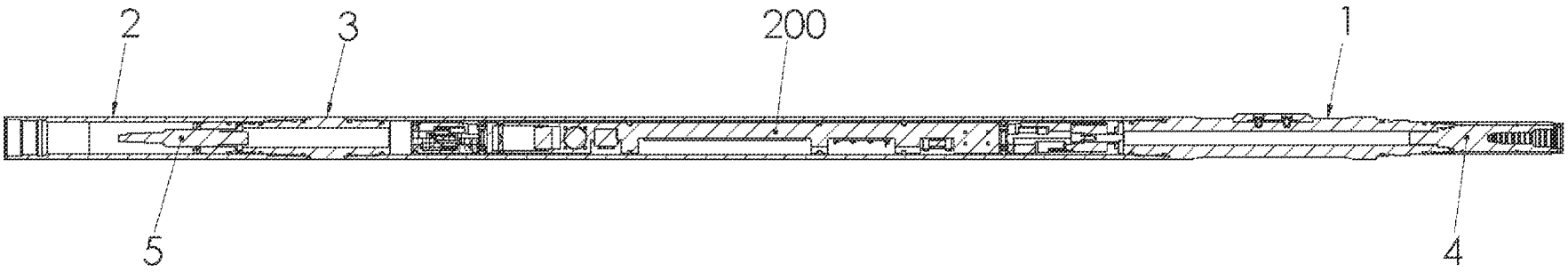
FIG. 5 shows the male connector assembly and the female connector assembly connected to a downhole instrument.

FIG. 5 shows a module that has a male connector assembly (including parts 3 and 5) connected to the proximal end of downhole instrument 200 and a female connector assembly (including parts 1 and 4) connected to the distal end of the downhole instrument 200. The downhole instrument 200 can be a directional sensor or other instruments, e.g., a pulser, a Gamma probe both non-focused and focused, a battery, an alternator, a gyroscope, a vibration monitor, a pressure sensor, an electromagnetic (EM) telemetry, resistivity sensor, a nuclear logging tool, or a sonic/acoustic sensor.

Modules such as shown in FIG. 5 can be connected to one another by connecting the male connector assembly in one module with the female connector assembly in an adjacent module, thereby forming a tool string having multiple downhole instruments sequentially connected.

Figure 6:
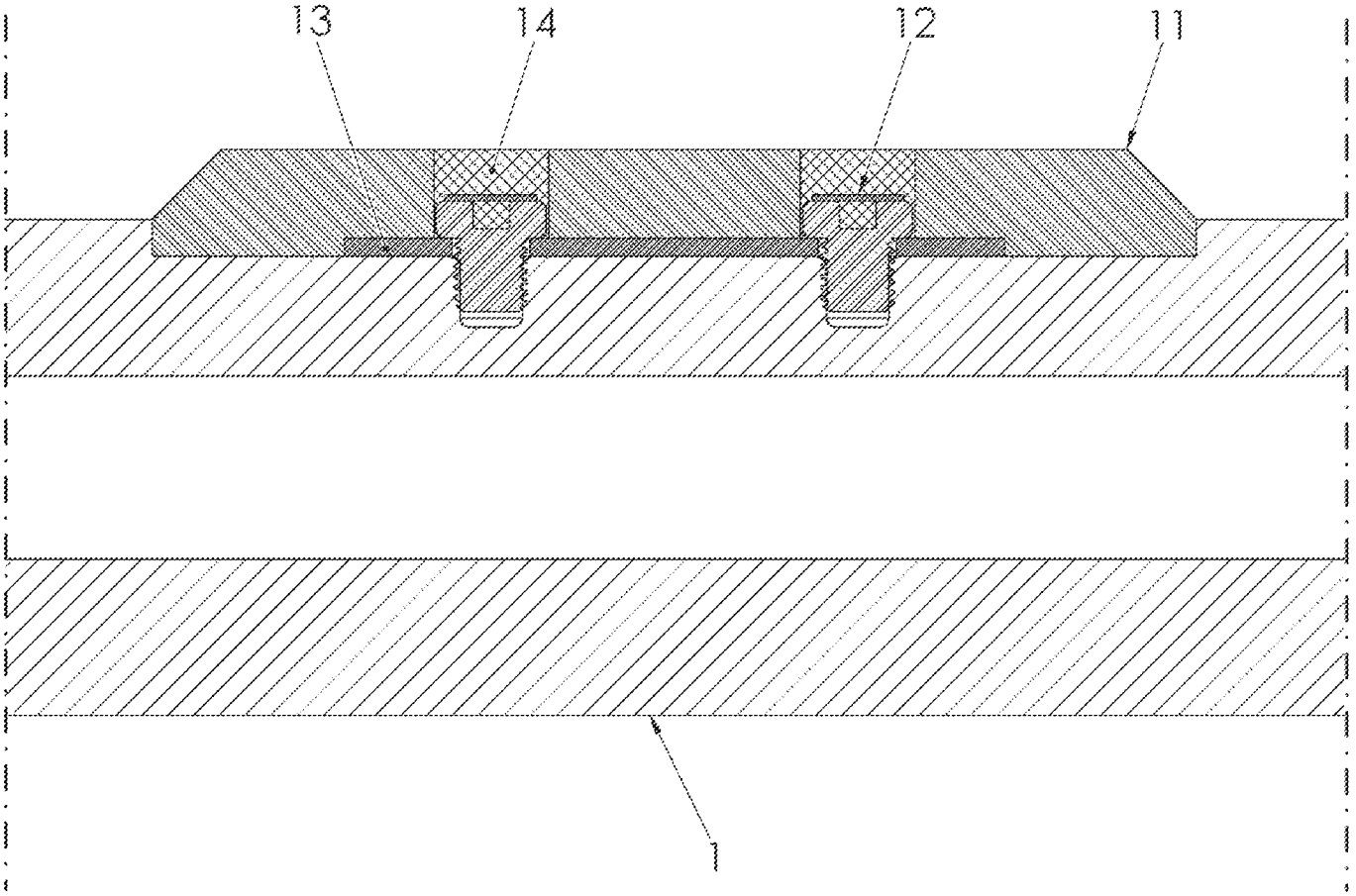
FIG. 6 shows details of the centralizer disposed on the female rotatable connector housing.

FIG. 6 shows a centralizer 11 on the housing 1 of the female connector assembly, which stabilizes the female connector assembly in the downhole sub. The centralizer 11 can be made of rubber, silicone, or other suitable materials. In this embodiment, it is affixed to the outer surface of housing 1 by two screws. The top of each screw is covered by a metal disk 12 (e.g., brass) while the screw holes are filled with a filler, such as the room temperature vulcanizing silicone, e. g., RTV. The filler 14 and the metal disks 12 prevent or delay corrosion.

While embodiments of this disclosure have been shown and described, modifications can be made by one skilled in the art without departing from the spirit or teaching of this invention. The embodiments described herein are exemplary only and are not limiting. Many variations and modifications of methods, systems and apparatuses are possible and are within the scope of the invention. Accordingly, the scope of protection is not limited to the embodiments described herein. The scope of protection is only limited by the claims. The scope of the claims shall include all equivalents of the subject matter of the claims.

What is claimed is:

1. An interconnector for connecting downhole instruments, comprising:

a male connector assembly and a female connector assembly, wherein:

the male connector assembly comprises a first housing and a male rotatable connector that are connected together, the female connector assembly has a second housing and a female rotatable connector, wherein the second housing is to receive the female rotatable connector, the male rotatable connector has a first end comprising a plurality of cylinders that are sequentially and concentrically connected, and a second end to receive a first plurality of electrical wires, a first plurality of electrical contacts disposed on the plurality of cylinders, and the female rotatable connector has a first end having a cavity having a plurality of steps to receive the plurality of cylinders in the male rotatable connector, and a second end to receive a second plurality of electrical wires, the male connector assembly is to be connected to a first end of a downhole instrument of the downhole instruments; and the female connector assembly is to be connected to a second end of the downhole instrument of the downhole instruments, and the downhole instrument is selected from a directional sensor, a pulser, a Gamma probe both non-focused and focused, a battery, an alternator, a gyroscope, a vibration monitor, a pressure sensor, an electromagnetic (EM) telemetry, resistivity sensor, a nuclear logging tool, and a sonic/acoustic sensor.

2. The interconnector of claim 1, further comprising one or more centralizers affixed to an outer surface of the second housing.

3. The interconnector of claim 2, wherein each of the one or more centralizers have one or more holes, each hole of the one or more holes receives a screw, a metal disk covering a top of the screw, and a filler sealing the one or more holes.

4. The interconnector of claim 1, wherein the male connector assembly and the female connector assembly are to be connected together by a tubular fastener.

5. The interconnector of claim 1, wherein the female rotatable connector is fastened to the second housing by a cap.

6. The interconnector of claim 1, wherein the male connector assembly further comprises a first machine key affixed to the second end of the male rotatable connector, a second machine key affixed to a first end of the first housing, and a split coupling to receive the first machine key and the second machine key so as to form a connection between the male rotatable connector and the first housing.

7. The interconnector of claim 6, wherein the first machine key is made from an epoxy resin.

8. A downhole instrument module, comprising a first downhole instrument connected to the interconnector of claim 1.

9. The downhole instrument module of claim 8, wherein the first downhole instrument is selected from a directional sensor, a pulser, a Gamma probe both non-focused and focused, a battery, an alternator, a gyroscope, a vibration monitor, a pressure sensor, an electromagnetic (EM) telemetry, resistivity sensor, a nuclear logging tool, and a sonic/acoustic sensor.

* * * * *